US010675863B2

(12) United States Patent
Capoia

(10) Patent No.: US 10,675,863 B2
(45) Date of Patent: Jun. 9, 2020

(54) INK-JET PRINTING DEVICE FOR COSTUMIZED PRINTING OF IMAGES ON SHEET-LIKE MATERIALS AND MACHINE WITH SUCH DEVICE

(71) Applicant: PANOTEC S.R.L., Cimadolmo (IT)

(72) Inventor: Giuseppe Capoia, Cimadolmo (IT)

( * ) Notice: Subject to any disclaimer, the term of this patent is extended or adjusted under 35 U.S.C. 154(b) by 0 days.

(21) Appl. No.: 15/569,439

(22) PCT Filed: May 2, 2016

(86) PCT No.: PCT/IB2016/052473

§ 371 (c)(1),
(2) Date: Oct. 26, 2017

(87) PCT Pub. No.: WO2016/174643

PCT Pub. Date: Nov. 3, 2016

(65) Prior Publication Data

US 2018/0297356 A1 Oct. 18, 2018

(30) Foreign Application Priority Data

Apr. 30, 2015 (IT) ..... 102015000013616

(51) Int. Cl.
*B41J 2/045* (2006.01)
*B41J 2/175* (2006.01)
(Continued)

(52) U.S. Cl.
CPC ..... *B41J 2/04508* (2013.01); *B31B 50/88* (2017.08); *B41J 2/04586* (2013.01); *B41J 2/175* (2013.01);
(Continued)

(58) Field of Classification Search
None
See application file for complete search history.

(56) References Cited

U.S. PATENT DOCUMENTS 6,082,851 A * 7/2000 Shihoh ..... B41J 2/175 347/85
6,533,383 B1 * 3/2003 Saruta ..... B41J 2/17503 347/19
(Continued)

FOREIGN PATENT DOCUMENTS

| | | |
|---|---|---|
| EP | 1331096 | 7/2003 |
| EP | 1442886 | 8/2004 |
| EP | 2529935 | 12/2012 |

*Primary Examiner* — Alejandro Valencia
(74) *Attorney, Agent, or Firm* — Themis Law

(57) ABSTRACT

An ink jet printing device for customized printing of images on a face of a sheet material includes a frame with a top surface defining a running plane for a face of the sheet material, with guides transverse to the running direction of the material, a printing unit that can move along the guides and has a printing head therein, a supply source supplying the printing head with printing ink, and a movement system driving the printing unit along the guides. The printing head faces the running plane for depositing the ink on the sheet material, and the supply source includes a secondary reservoir, mounted in the printing unit and in fluid connection with the head, and a main reservoir in fluid connection with the secondary reservoir for refilling the secondary reservoir and maintaining the level of ink above a predetermined threshold value, ensuring supply to the printing head.

2 Claims, 6 Drawing Sheets

(51) Int. Cl.

| | |
|---|---|
| ***B41J 13/00*** | (2006.01) |
| ***B41J 11/00*** | (2006.01) |
| ***B41J 29/02*** | (2006.01) |
| ***B31B 50/88*** | (2017.01) |

(52) U.S. Cl.
CPC ..... *B41J 2/17566* (2013.01); *B41J 2/17596* (2013.01); *B41J 11/001* (2013.01); *B41J 13/0063* (2013.01); *B41J 29/02* (2013.01)

(56) References Cited

U.S. PATENT DOCUMENTS

| | | | | |
|---|---|---|---|---|
| 7,364,256 | B2 * | 4/2008 | Berry | B41J 2/16511 347/29 |
| 8,651,657 | B2 * | 2/2014 | Oraa | B41J 29/13 347/108 |
| 8,727,493 | B2 * | 5/2014 | Cofler | B41J 25/005 347/12 |
| 2004/0135829 | A1 | 7/2004 | Yoshida | |
| 2008/0002011 | A1 | 1/2008 | Mizutani | |

* cited by examiner

INK-JET PRINTING DEVICE FOR COSTUMIZED PRINTING OF IMAGES ON SHEET-LIKE MATERIALS AND MACHINE WITH SUCH DEVICE

FIELD OF THE INVENTION

The present invention generally finds application in the field of printing systems for sheet materials and particularly relates to a ink jet printing device for customized printing of images on outer or inner faces of packages, which is particularly suitable for installation on automatic machines for production of successive packages from a sheet material, such as corrugated cardboard or the like.

The invention further relates to a machine for forming packages from a sheet material, which incorporates such printing system.

BACKGROUND ART

Printing of relatively rigid sheet materials, e.g. made of corrugated cardboard or the like is known to be carried out using printing devices equipped with heads for printing a given surface of the material.

Particularly, these devices can be employed for the so-called large-format printing, as they can print large surfaces of sheet material, during continuous feeding of the latter.

For example, these devices are installed in plotters for limited edition printing, or in industrial printers designed for reel printing or stacks of folded material.

Typically, these heads are of ink jet type and may be electronically controlled to perform digital printing with continuous and very quick changes of printed designs while the material is being processed, as needed.

In cardboard-processing machines, for instance in customized package formation, there is a strong need to print the material almost over its entire width, as it is being continuously fed through the printing station.

A widely used arrangement to obtain such result is to install a plurality of fixed heads, offset over the width of the cardboard, such that the entire width of the latter may be covered by joining predetermined printing areas associated with respective heads.

US2008/0002011 discloses a method of manufacturing a corrugated cardboard product in which the printing step is carried out using an ink jet printer configured as described above.

Particularly, this printer comprises two fixed units, each composed of three ink jet heads arranged side-by-side in a corresponding transverse direction. The two units are longitudinally offset and placed above the cardboard to cover a printing area that is substantially equal to its entire width. The printer also has means for continuous feeding of the cardboard through the printing units, such that the latter are allowed to print the top surface of the material while being firmly secured to the frame of the printer.

One drawback of this prior art is the great number of heads required for printing the cardboard over its entire width, which becomes a dramatic limitation when printing large cardboard packages. Furthermore, this arrangement adds great complexity to the construction of the control unit of the printer, which is required to simultaneously control a great number of heads.

An attempt to obviate these drawbacks has been the development of printing units for cardboard or other similar sheet materials that have a smaller number of heads, the latter not being fixed, but moving along the transverse dimension of the material.

IT1394154, issued to the applicant hereof, discloses a device for printing sheet material, preferably for packaging use. This device has one or more printheads, arranged below the material feed plane to print the bottom face of the material, which forms the outer face of the package. The head is mounted to a transversely moving carriage, to sweep the entire width of the sheet material, for bottom-up printing of any area thereof.

While this arrangement is more versatile than fixed-printing unit configurations, it is still affected by drawbacks.

A first drawback of this arrangement is that the particular accommodation of the head below the material feed plane increases the risk of irregular bottom-up ink flow, thereby providing an imperfect printing image.

For optimal smearless, flawless printing, the head must be constantly supplied with a pressurized ink flow, and this is particularly difficult when upward ink ejection has to be promoted, against the force of gravity.

Furthermore the head receives ink from an external ink reservoir, which is connected thereto via a relatively long tube, which reduces supply pressure at the printhead nozzles.

An additional drawback of this prior art printing device is its complex assembly, due to need to manually connect the end of the ink supply tube to the sleeve attached to the bottom wall of the head, in a location that is hardly reachable by the operator.

Another drawback is that the head is secured to the carriage in cantilever arrangement with no particular protection, and is thus exposed to inadvertent impacts by various objects as it moves or during maintenance and cleaning.

Finally, replacement or removal of each head from the device is a time-consuming operation, because the operator is required to manually disconnect the ink supply duct and separate the head from the carriage in a narrow, hardly-accessible space.

Technical Problem

In light of the prior art, the technical problem addressed by the present invention consists in providing a ink jet printing device for customized printing of images on package faces, that can provide high printing quality and resolution in any condition of use, while ensuring highly simple installation and maintenance.

DISCLOSURE OF THE INVENTION

The object of the present invention is to solve the aforementioned technical problem and obviate the above drawbacks, by providing a ink jet printing device for customized printing of images on package faces that is highly efficient and relatively cost-effective.

A particular object of the present invention is to provide a ink jet printing device for customized printing of images that can print package faces at a high resolution, thereby achieving a high printing quality.

A particular object of the present invention is to provide a ink jet printing device for customized printing of images on package faces, that can be easily assembled and accessed, thereby allowing mounting and removal thereof to take place in very short times.

Another object of the present invention is to provide a ink jet printing device for customized printing of images on package faces, that has a flexible printhead configuration, to easily change the number of simultaneously operating heads.

A further object of the present invention is to provide a ink jet printing device for customized printing of images on package faces, that can protect printheads and any moving part associated therewith from impacts with various objects in the installation environment.

These and other objects, as better explained hereafter, are fulfilled by a ink jet printing device for customized printing of images on package faces as defined in claim 1.

In a further aspect, the invention relates to an automatic machine for production of successive packages as defined in claim 12.

Advantageous embodiments of the invention are obtained in accordance with the dependent claims.

BRIEF DESCRIPTION OF THE DRAWINGS

Further features and advantages of the invention will be more apparent from the detailed description of a preferred, non-exclusive embodiment of a ink jet printing device for customized printing of images on package faces, which is described as a non-limiting example with the help of the annexed drawings, in which.

DETAILED DESCRIPTION OF A PREFERRED EMBODIMENT

Figure 1:
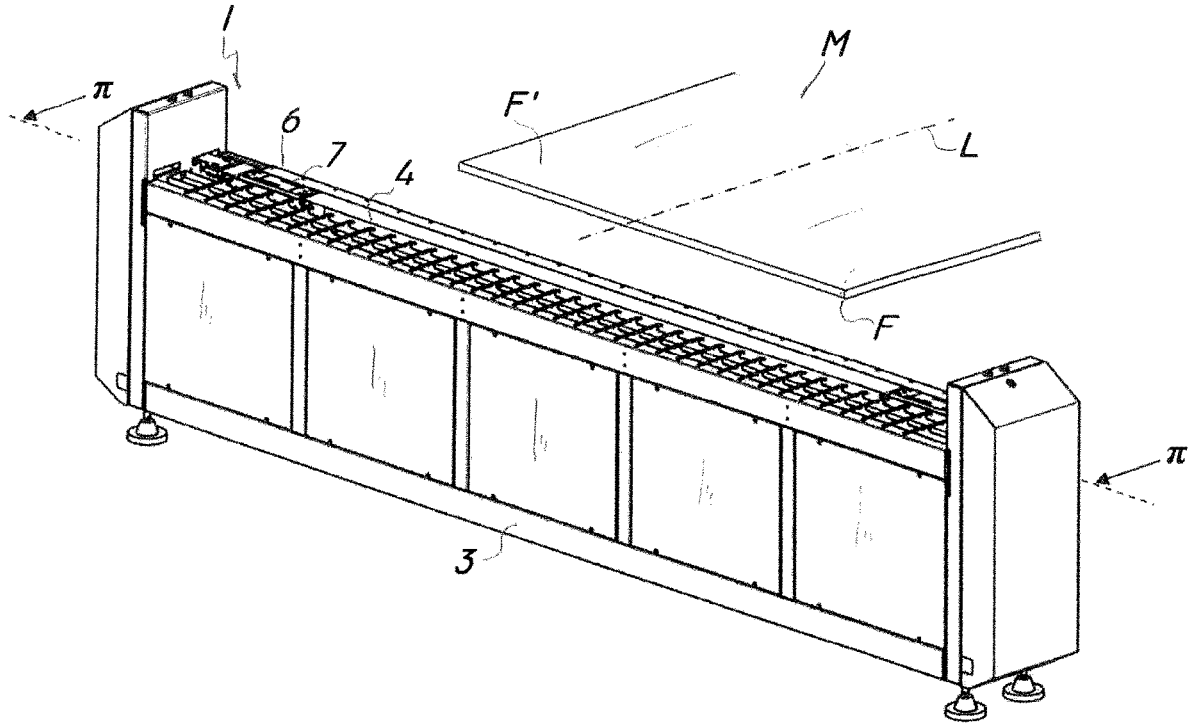
FIG. 1 is a perspective view of a printing device of the invention.

Particularly referring to FIG. 1, numeral 1 generally shows and designates a device for customized ink jet printing on faces F, F' of a package made of sheet material M, such as corrugated cardboard or the like.

The device is particularly suitable for installation in a packaging machine, generally designated by numeral 2, which is designed to form customized packages from a sheet of relatively rigid material M, preferably cardboard or the like, which is fed from continuous folded webs or reels in a substantially horizontal longitudinal direction L.

The machine 2 can be further configured to promote feeding of the sheet material M with one face F, F' downwards, which is designed to be printed with an image, text or a decorative element.

The device 1 comprises an elongate frame 3 that can rest on the ground by means of adjustable feet, an extends transverse to the longitudinal direction L of feed of the material M. The frame 3 has a substantially horizontal top surface 4, which is adapted to define a running plane π for the material M to be printed as it comes out of the machine 2.

The frame 3 comprises stationary guide means 5 which are adapted to slidably support at least one printing unit 6 having one or more printing heads 7 therein, preferably of ink jet type.

Figure 3:
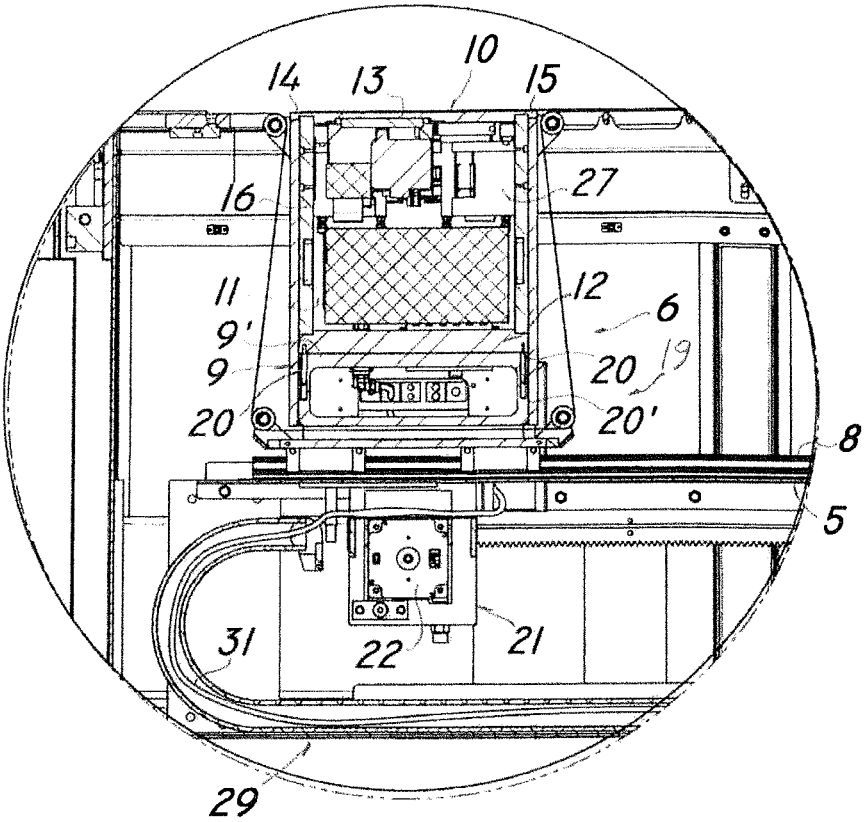
FIG. 3 is an enlarged front view of a printing unit located in the device of FIG. 1.
Figure 5A:
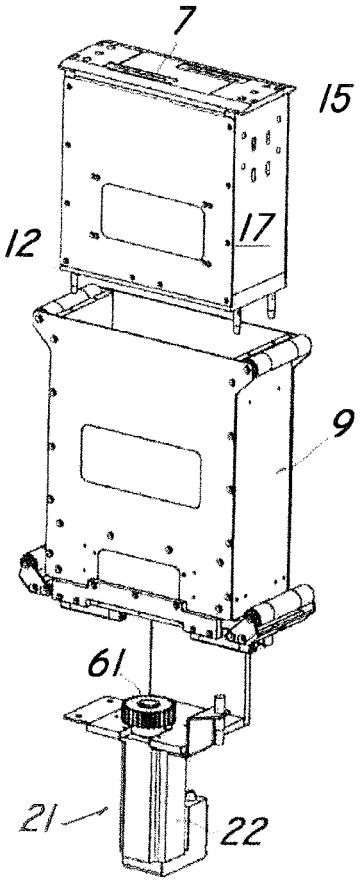
FIGS. 5A and 5B are lateral and broken-away perspective views of a first detail of FIG. 1 respectively.
Figure 5B:
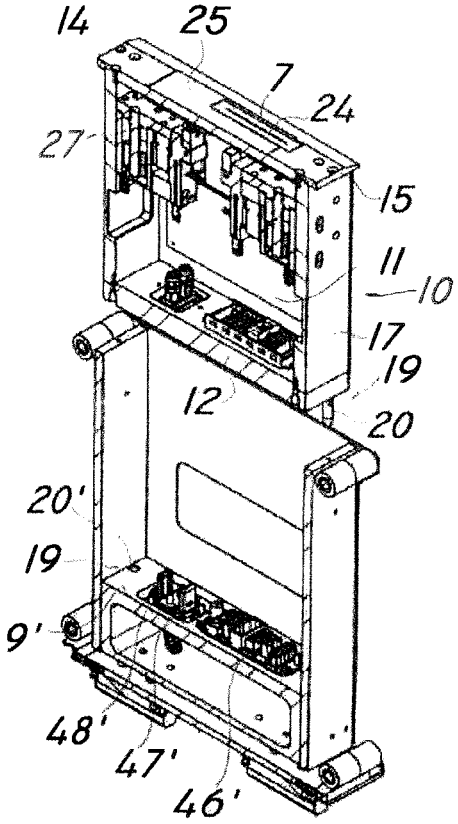
Figure 6A:
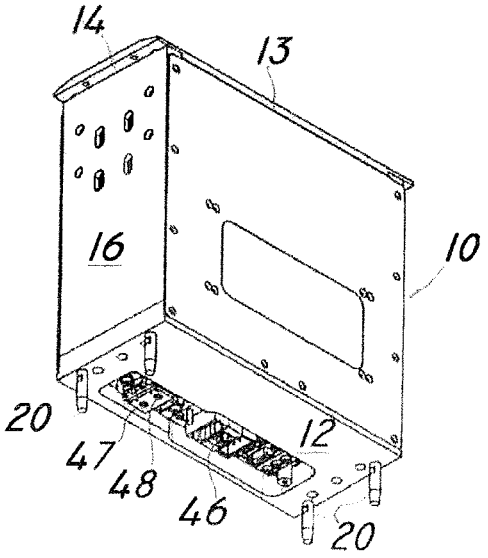
FIGS. 6A and 6B are bottom and open lateral perspective views of a first embodiment of the printing unit as shown in FIGS. 5A and 5B respectively.
Figure 6B:
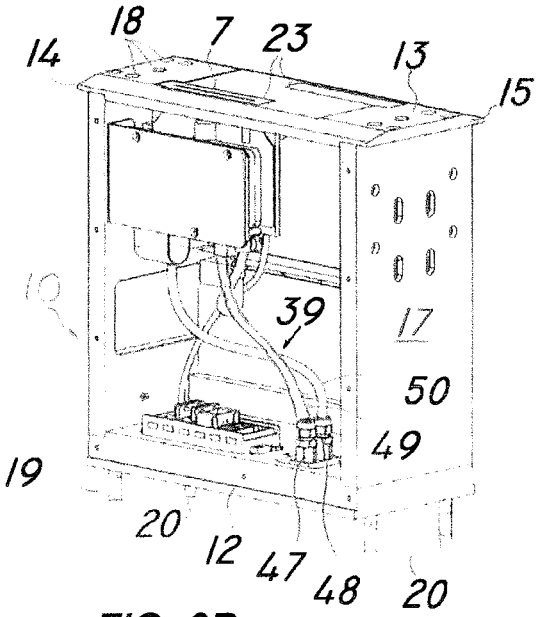

Particularly, the guide means 5 may comprise at least one transverse guide 8 with a guide drawer 9 slidably mounted thereto, as shown in FIGS. 3,5A and 5B, for housing a respective printing unit 6.

In order to increase the printing speed, the device 1 may comprise a plurality of printing units 6, mounted to the guide means 5 in longitudinally offset positions.

In this case, the printing units 6 are removably coupled to a corresponding drawer that slides on the longitudinally offset transverse guides 8.

In the illustrated embodiment, each printing unit 6 comprises a box-like casing 10 having an inner compartment 11 and designed to be removably coupled to a corresponding drawer 9.

In the illustrated embodiment, the box-like casing 10 comprises a bottom wall 12 and a top wall 13 having the printing heads 7 secured thereto, and joined at its ends 14, 15 to a pair of substantially vertical protective side walls 16, 17.

Advantageously, the top wall 13 and the side walls 16, 17 may be removably joined by suitable connection members 18, such that the casing 10 can be opened at its sides or at the top for insertion of the heads 7 and easy access to the inner compartment 11.

Conveniently, quick connection means 19 may be provided in association with the box-like enclosure 10 and to a transverse wall 9' within the drawer 9, for removable connection thereof with a corresponding printing unit 6.

Particularly, the quick connection means 19 may comprise a plurality of vertical pins 20 projecting out of the bottom wall 12 of each unit 6 and designed for friction- or snap-fit engagement in corresponding seats 20' formed on the respective drawer 9, and only partially visible in FIGS. 3 and 5B.

The printing unit 6 may be easily removed from the drawer 9 by pulling the casing 10 upwards, to thereby disengage the pins 20 from the corresponding seats.

Movement means 21 are also provided for moving the printing unit 6 along the guide means 5, and may comprise at least one electric motor 22 located below the drawer 9 and having a gear 61, as shown in FIG. 5A, that interacts with teeth, not shown, rigidly joined to its respective transverse guide 8.

The top wall 13 of the casing 10 may have corresponding suitably shaped openings 23 allowing insertion and removal of printing heads 7, such that the nozzles 24 of the latter for supplying ink I are substantially flush with the top surface 25 of the casing 10.

Therefore, the printing unit 6 will be located below and in facing relationship to the substantially horizontal running plane π that defines the running surface 4 for the material M on the frame 3, such that ink I will be ejected upwards, for printing the bottom face F of the material M.

In the embodiment as shown in FIGS. 1 to 8B, each printing unit 6 may house a single printing head 7. In the embodiment as shown in FIGS. 9A and 9B, each unit 6 may contain two printing heads 7.

Of course the number of heads accommodated in a single unit may also be greater than two without departure from the scope of the invention.

Figure 9A:
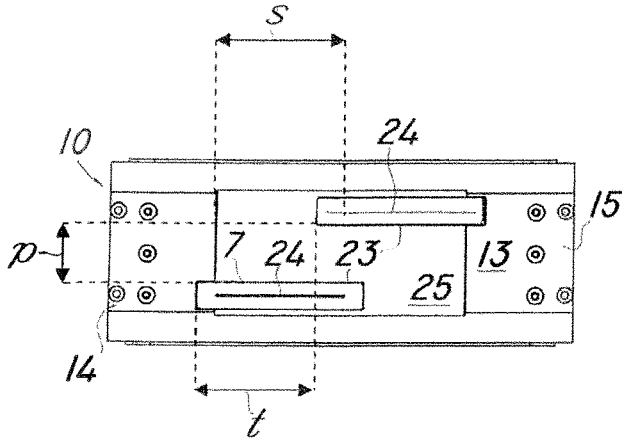
FIGS. 9A and 9B are top and lateral broken-away views of an alternative configuration of the printing unit respectively.
Figure 9B:
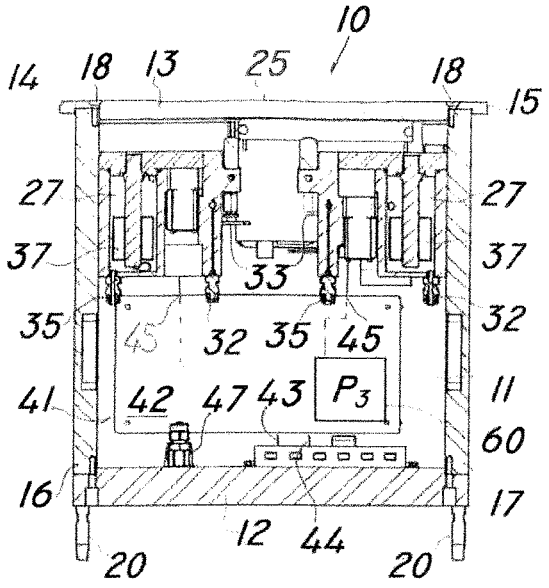

When the printing unit 6 contains two or more heads 7, as shown in FIG. 9A, they are offset both in the transverse direction and in the longitudinal direction, with respective distances t and p therebetween, such that their printing widths s at least partially overlap in the transverse direction.

Such transverse overlap will increase the printing width of a single unit 6. For example, using up to four adjacent heads 7, each with a printing width s of 70 mm, continuous printing is allowed over a face of the sheet material having a width ranging from 70 mm to 280 mm.

For example, each head 7 will be of the high-resolution type, with a definition of not less than 180 dpi, for lengths equal to or higher than 10 m.

According to the invention, the device 1 comprises appropriate supply means 26 for supplying each head 7 with a corresponding printing ink I. For example, the supply means 26 may supply all the printing heads 7 with the same ink I, for monochrome printing of the material M.

Alternatively, the supply means 26 may be configured to supply the heads 7 with inks I of different colors, four color printing of the sheet material M.

A peculiar feature of the invention is that the supply means 26 comprise a secondary reservoir 27 for ink I, which is mounted in the moving printing unit 6 in direct fluid connection with the head 7, and is connected to a main reservoir 28 for ink I, that is fixed and rigidly joined to the frame 3 for refilling the secondary reservoir 27.

Thus, the level w of ink I in the secondary reservoir 27 will be maintained substantially constant and/or above a predetermined threshold value $w_s$ that can ensure continuous ejection of ink I from the nozzles 24 of the printing heads 7.

Figure 2:
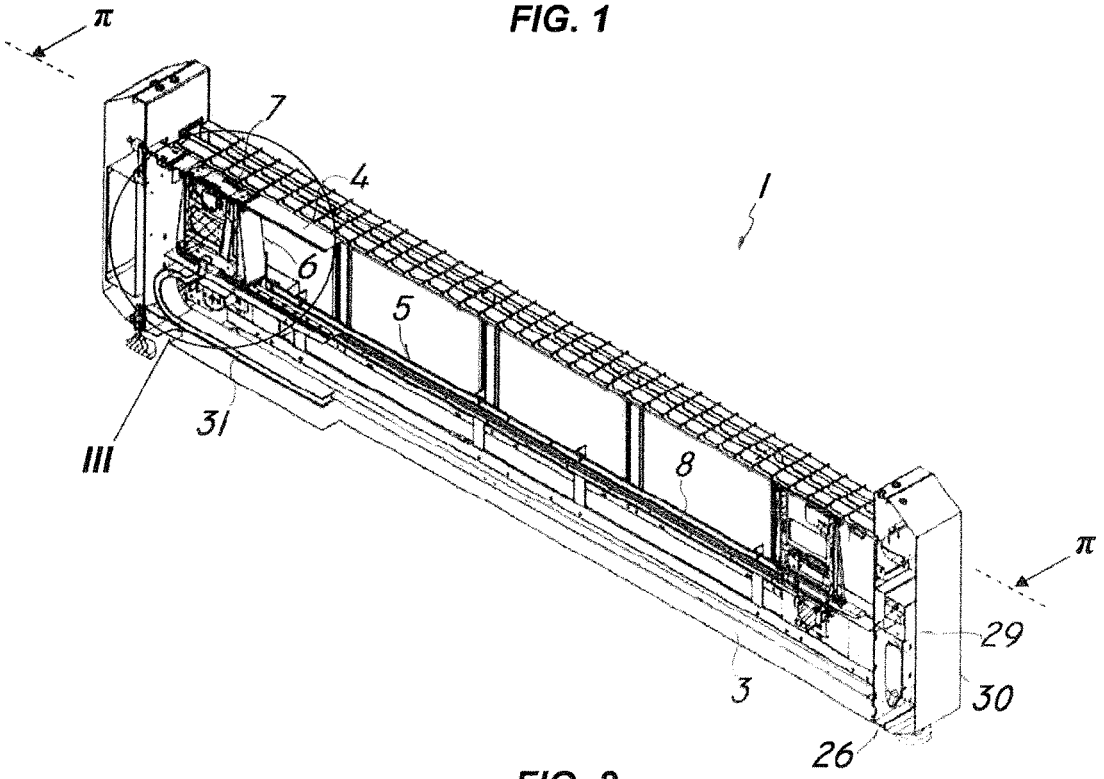
FIG. 2 is a broken-away perspective view of FIG. 1.
Figure 4:
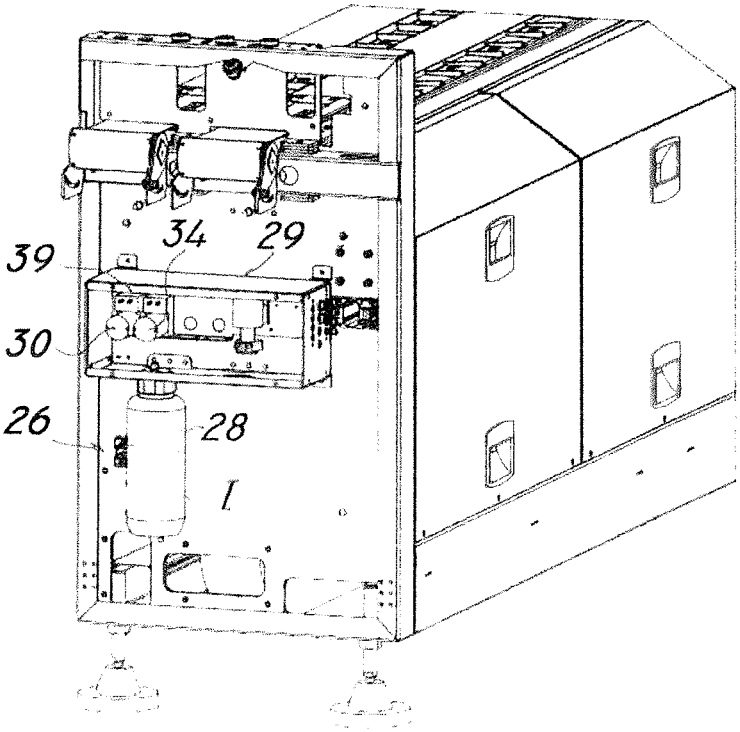
FIG. 4 is a partial perspective view of the device of FIG. 1.

In the embodiment as shown in FIGS. 2 to 4, the main reservoir 28 is connected to the secondary reservoir 27 via a hydraulic circuit 29 having a pump 30 for supplying ink I to the heads 7. The hydraulic circuit 29 may comprise a flexible hose 31, to accommodate translational movement of the printing units 6 relative to the main reservoir 28, while remaining connected therewith.

Preferably, each printing head 7 will be in fluid connection with a single secondary reservoir 27 which will in turn be connected to the main reservoir 28 via the hydraulic circuit 29. Furthermore, each secondary reservoir 27 will comprise an inlet 32 for ink I, an inlet 33 for air, connected to a compressor 34, and an outlet 35 for ink I, which is directly connected to the head 7 by a flexible hose 36.

Figure 7:
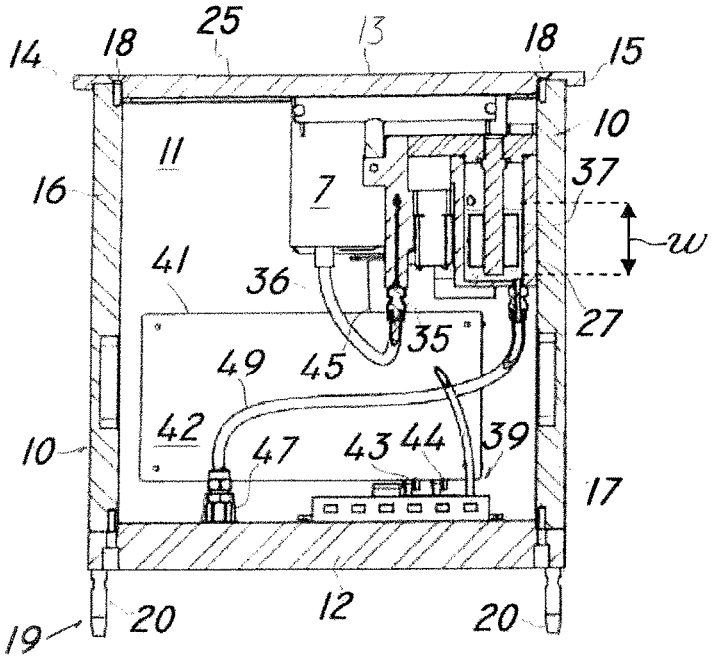
FIG. 7 is a lateral broken-away view of the unit of FIGS. 6A and 6B.
Figure 8A:
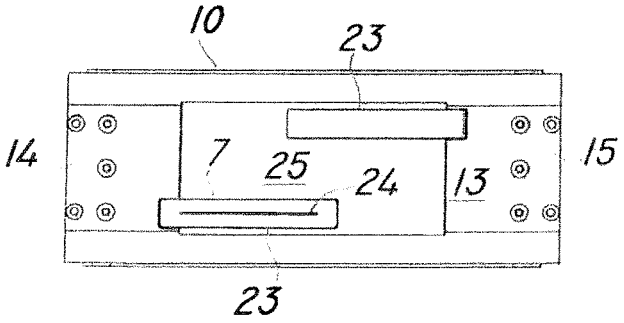
FIGS. 8A and 8B are top and bottom views of the printing unit of FIGS. 6A and 6B respectively.
Figure 8B:
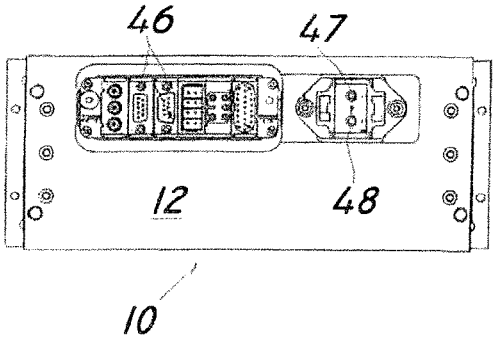

As best shown in FIGS. 7 and 9B, the secondary reservoir 27 may be secured to the top wall 13 of the casing 10 near the head 7 and may contain a level sensor 37 operably connected to the pump 30.

The level sensor 37 will selectively actuate the pump 30 when the level w of ink I in the secondary reservoir 27 falls below the threshold value $w_s$, to thereby restore it in real time.

Figure 10A:
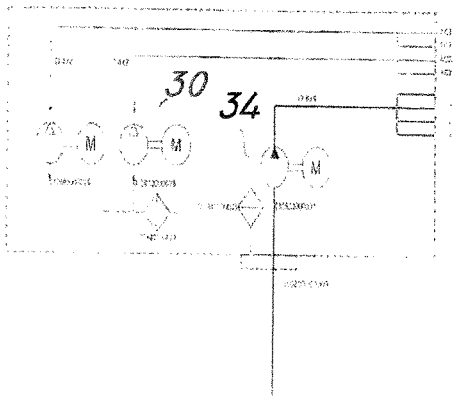
FIGS. 10A and 10B are hydraulic diagrams of the device of FIG. 1.
Figure 10B:
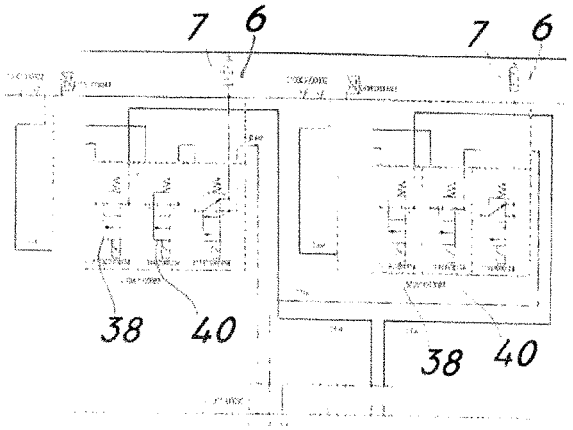

Furthermore, as shown in the diagram of FIG. 10*b*, a first solenoid valve 38 may be housed along the hydraulic circuit 29 and within each casing 10, upstream from the secondary reservoir 27 for checking its fill state and preventing any leakage of ink I if the printing unit 6 is turned upside down.

The secondary reservoir 27 is also connected to a pneumatic circuit 39 with the compressor 23 for compressing air therein. The pneumatic circuit 39 is equipped with a second solenoid valve 40 interposed between the compressor 34 and the secondary reservoir 27 for pressurizing the latter and allowing drainage of ink I during maintenance.

Electronic control means 41 are also provided, which are connected to the movement means 21 and the heads 7 for controlling delivery of ink I through the nozzles 24 according to the instantaneous position of the printing unit 6.

In other words, the electronic control means 41 are used to actuate the printing heads 7 when the latter are in a given position in which a text or an image is to be printed.

In the illustrated embodiment, the electronic control means 41 comprise a board 42 located within the box-like casing 10 and having at least one first input 43 for power supply, a second input 44 for receiving printing data and at least one output 45 electrically connected to the head 7 for controlling delivery of ink I.

For this purpose, the bottom wall 12 of the casing 10 is equipped with at least one electric connector 46, which is connected to the inputs 43, 44 of the electronic board 42 and at least one pair of quick couplings 47, 48 in fluid connection to the inputs 32, 33 for ink I and air of the secondary reservoir 27.

The quick couplings 47, 48 are connected to the inlets 32, 33 of the secondary reservoir 27 via rubber or plastic hoses 49, 50.

Furthermore, the connectors 46 and the quick couplings 47, 48 may be of male or female type and are designed to fit onto corresponding matingly-shaped connectors 46' and quick couplings 47', 48' mounted to the drawer 9.

Advantageously, the matingly-shaped connectors may be mounted to the transverse wall 9' of the drawer 9 to promote electrical connection with the board 42 and fluid connection with the secondary reservoir 27 as soon as the printing unit 6 is fitted therein.

Figure 11:
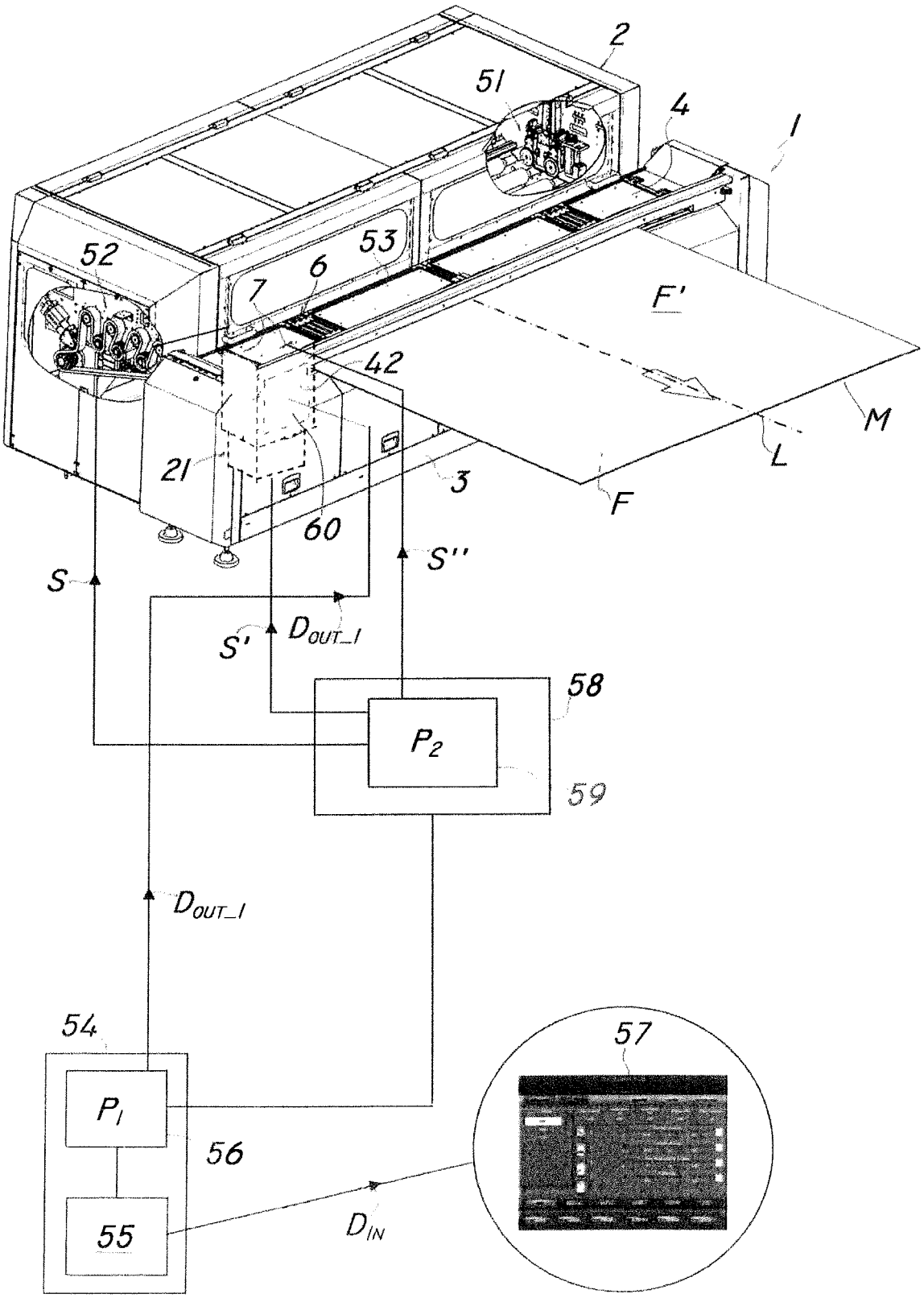
FIG. 11 is a perspective view of a machine for production of successive packages, which is equipped with the printing device of FIG. 1.

In a further aspect the invention relates to a machine 2 for forming customized packages, which has the printing device 1 installed thereon, and is as shown in FIG. 11 and of conventional type, e.g. as disclosed in patent IT1394155 by the applicant hereof. This machine has cutting and creasing means 51 therein, as well as means 52 for controlled feeding of the material M in the longitudinal direction L.

An exit opening 53 or the cut and/or creased material is provided downstream from the cutting and creasing means 51, and is aligned with the running plane π that supports the sheet material M and contacts its bottom face F.

A printing device 1 as disclosed above is placed downstream from the exit opening 53, for printing the bottom face F of the sheet material M by one or more printing heads 7 configured for upward ejection of ink I.

The machine 2 also comprises interface means 54, which are designed to be operated by a user for entering first input data $D_{IN}$ concerning the configuration of the package to be formed and the areas and images to be printed.

In the illustrated exemplary embodiment, the interface means 54 comprise a monitor or display 55 with a keyboard or possibly a touchscreen, connected to a first microprocessor 56 with a storage unit having a first computer product $P_1$ installed therein.

The first microprocessor 56 will process the information $D_{IN}$ contained in the graphic screen 57 in accordance with the instructions in the first computer product $P_1$ to generate first output data $D_{OUT_1}$ associated with the print designs and second output data $D_{OUT_2}$ related to the position of such print designs on the sheet material M.

Particularly, the position data $D_{OUT_2}$ may contain the Cartesian coordinates ($X_i$, $Y_i$) of the points $P_1$ of the face F of the sheet material M that will be printed upon by the heads 7. These Cartesian coordinates ($X_i$, $Y_i$) may be calculated relative to a fixes reference point $P_{REF}$ of the machine 2 defined by preset space coordinates ($X_{REF}$, $Y_{REF}$).

The first printing data $D_{OUT_1}$ will be directly sent to the electronic board 42 of one or more printing units 6 whereas the second printing data $D_{OUT_2}$ will be sent to a processing unit 58, generally a PLC or a computer, which is equipped with a second microprocessor 59 with a storage unit having a second computer product $P_2$ installed therein.

The second microprocessor 59 will process the second printing data $D_{OUT_2}$ to generate appropriate control signals s, s', that will be sent to the feed means 52 for feeding the sheet material M on the running plane π and to the drive means 21 for the printing unit 6 respectively.

Furthermore, the second microprocessor 59 will also send an actuation signal s" for actuating the printing heads 7 according to the instantaneous position of the sheet material M to be printed.

Particularly, the electronic board 42 within each printing unit 6 will be equipped with a third processor 60 with a third computer product $P_3$ or firmware, installed therein, having instruction for processing the printing data $D_{OUT_1}$ that has been sent by the interface means 54 to generate appropriate electric signals directly sent to the corresponding head 7 and adjust delivery of ink I according to the desired print design.

Thus, the transmission of the printing data $D_{OUT_1}$ and the position data $D_{OUT_2}$ by the interface means 54 and the processing unit 58, will allow synchronization of the position of the printing heads 7 relative to the position of the sheet material M for printing the desired design at the areas that have been selected by the user through the interface means 54.

The device and machine of this invention are susceptible to a number of changes or variants, within the inventive concept disclosed in the appended claims. All the details thereof may be replaced by other technically equivalent parts, and the materials may vary depending on different needs, without departure from the scope of the invention.

While the device and machine have been described with particular reference to the accompanying figures, the numerals referred to in the disclosure and claims are only used for the sake of a better intelligibility of the invention and shall not be intended to limit the claimed scope in any manner.

INDUSTRIAL APPLICABILITY

The present invention may find application in industry, because it can be manufactured on an industrial scale in factories for production of machines designed for processing of semirigid sheet products, such as cardboard or the like, or for production of package-forming machines.

The invention claimed is:

1. An ink jet printing device (1) for customized printing of images on a sheet material (M), comprising:

a frame (3) with a top surface (4) defining a substantially horizontal running plane (π) for the sheet material (M) to be printed, said sheet material having a bottom face (F) and a top face (F'), said frame (3) having guides (8) transverse to a running direction (L) of the sheet material (M);

a printing unit (6) movable along said guides (8) and having a printing head (7) therein;

a supply source (26) supplying said printing head (7) with printing ink (I);

a movement system (21) moving said printing unit (6) along said guides (8);

wherein said printing head (7) faces said running plane (π) for depositing the ink (I) on the face (F, F') of the sheet material (M) to be printed;

wherein said supply source (26) comprises a main reservoir (28) mounted onto said frame (3) at a predetermined height and a secondary reservoir (27);

wherein said secondary reservoir (27) is mounted in said printing unit (6) and is in fluid connection with said printing head (7), said secondary reservoir (27) being in fluid connection with said main reservoir (28) via a hydraulic circuit (29) having a pump (30) for selective supply of ink (I);

wherein said printing unit (6) is positioned below and in facing relationship to said running plane (π), such that the at least one printing ink (I) is ejected upward to print the bottom face (F) of the sheet material (M); and wherein said hydraulic circuit (29) is designed to maintain a level (w) of the printing ink (I) in said secondary reservoir (27) substantially constant and above a predetermined threshold value ($w_s$) to provide for a continuous supply to said at least one printing head (7);

wherein said printing unit (6) comprises a substantially box-shaped casing (10) for removably containing said printing head (7), said box-shaped casing being adapted to be removably secured to a guide drawer (9) slidably mounted on said transverse guides (8);

further comprising a quick connection system (19) associated with said casing (10) and said drawer (9) for removable snap fit connection of said printing unit (6) into the corresponding guide drawer (9);

wherein said movement system (21) comprises a motor (22) for driving said a printing unit (6) along said guides (8), an electronic control system (41) being provided, which is operably associated with said motor (22) and said printing head (7) for controlling delivery of the printing ink (I) according to a position of the printing unit (6);

wherein the electronic control system (41) comprises an electronic board (42) housed in the box-shaped casing (10) and having a first input (43) for power supply and a second input (44) for receiving printing data, and an output (45) connected to the printing head (7) for controlling delivery of the printing ink (I);

wherein the box-shaped casing (10) has a bottom wall (12) with an electric connector (46) connected to the first input (43) and the second input (44) of the electronic board, (42) and a pair of quick couplings (47, 48) in fluid connection with the secondary reservoir (27), the electric connector (46) and the pair of quick couplings (47, 48) being designed to be fitted into respective matingly-shaped connector and quick couplings at the guide drawer (9); and wherein the box-shaped casing (10) is inserted downwardly into the guide drawer (9) so as to cause the electric connector (46) on the bottom wall (12) of the box-shaped casing (10) to connect with the respective matingly-shaped connector inside the guide drawer, the printing head (7) being disposed on a top side of the box-shaped casing (10).

2. An automatic machine (2) for production of customized packages from a sheet material (M), comprising:

a running plane (π) for supporting the sheet material (M) while fed;

cutting and creasing devices (51) for making cuts and/or fold lines on the sheet material (M) placed on said running plane (π);

a controlled feeding system (54) of the sheet material (M) supported by said running plane (π) in a longitudinal direction (L); and an ink jet printing device (1) for customized printing of images, comprising:

a frame (3) with a top surface (4) defining the running plane (π) in a substantially horizontal position for the sheet material (M) to be printed, said sheet material having a bottom face (F) and a top face (F'), said frame (3) having guides (8) transverse to a running direction (L) of the sheet material (M);

a printing unit (6) movable along said guides (8) and having a printing head (7) therein;

a supply source (26) supplying said printing head (7) with printing ink (I);

a movement system (21) moving said at least one printing unit (6) along said guides (8);

wherein said printing head (7) faces said running plane (π) for depositing the ink (I) on the bottom face (F) of the sheet material (M) to be printed;

wherein said supply source (26) comprises a main reservoir (28) mounted onto said frame (3) at a predetermined height and a secondary reservoir (27);

wherein said secondary reservoir (27) is mounted in said printing unit (6) and is in fluid connection with said printing head (7), said secondary reservoir (27) being placed at a constant height between said main reservoir (28) and said printing head (7) and being in fluid connection with said main reservoir (28) via a hydraulic circuit (29) having a pump (30) for selective supply of ink (I), and designed to refill said secondary reservoir (27);

wherein said printing unit (6) comprises a substantially box-shaped casing (10) for removably containing said printing head (7), said box-shaped casing being adapted to be removably secured to a guide drawer (9) slidably mounted on said transverse guides (8);

further comprising a quick connection system (19) associated with said casing (10) and said drawer (9) for removable snap fit connection of said printing unit (6) into the corresponding guide drawer (9);

wherein said movement system (21) comprises a motor (22) for driving said a printing unit (6) along said guides (8), an electronic control system (41) being provided, which is operably associated with said motor (22) and said printing head (7) for controlling delivery of the printing ink (I) according to a position of the printing unit (6);

wherein the electronic control system (41) comprises an electronic board (42) housed in the box-shaped casing (10) and having a first input (43) for power supply and a second input (44) for receiving printing data, and an output (45) connected to the printing head (7) for controlling delivery of the printing ink (I);

wherein the box-shaped casing (10) has a bottom wall (12) with an electric connector (46) connected to the first input (43) and the second input (44) of the electronic board, (42) and a pair of quick couplings (47, 48) in fluid connection with the secondary reservoir (27), the electric connector (46) and the pair of quick couplings (47, 48) being designed to be fitted into respective matingly-shaped connector and quick couplings at the guide drawer (9);

wherein the box-shaped casing (10) is inserted downwardly into the guide drawer (9) so as to cause the electric connector (46) on the bottom wall (12) of the box-shaped casing (10) to connect with the respective matingly-shaped connector inside the guide drawer, the printing head (7) being disposed on a top side of the box-shaped casing (10);

wherein said ink jet printing device (1) is placed downstream from said cutting and creasing devices (51) for printing said bottom face (F) of the sheet material (M) supported by said running plane (π);

wherein said transverse guides (8) are located below said running plane;

wherein said printing unit (6) is positioned below and in facing relationship to said running plane (π), such that the printing ink (I) is ejected upward to print the bottom face (F) of the sheet material (M); and wherein said hydraulic circuit (29) is designed to maintain a level (w) of the printing ink (I) in said secondary reservoir (27) substantially constant and above a predetermined threshold value ($w_s$) to provide for a continuous supply to said at least one printing head (7).

* * * * *